US005095965A

United States Patent [19]

Higashiyama

[11] Patent Number: 5,095,965

[45] Date of Patent: Mar. 17, 1992

[54] SHUTTER AND A SLAT FOR THE SAME

[76] Inventor: Hideo Higashiyama, 816, Oaza Maeyama, Saku-shi, Nagano-ken, Japan

[21] Appl. No.: 593,911

[22] Filed: Oct. 5, 1990

[30] Foreign Application Priority Data

Oct. 13, 1989 [JP] Japan ..... 1-267840
Dec. 22, 1989 [JP] Japan ..... 1-334294

[51] Int. Cl.[5] ..... E06B 9/08

[52] U.S. Cl. ..... 160/133; 160/236; 160/201; 49/171; 454/174; 454/212; 454/250

[58] Field of Search ..... 160/133, 201, 236; 98/87, 41.3; 49/171

[56] References Cited

U.S. PATENT DOCUMENTS 1,592,667 7/1926 Lewis ..... 98/87 X
1,876,750 9/1932 Reed ..... 160/133
1,929,219 10/1933 Sevison ..... 49/171
2,208,039 7/1940 Mills ..... 160/133
2,390,116 12/1945 Michelman ..... 160/133
2,621,726 12/1952 Greegor ..... 160/180 X
2,624,263 1/1953 Klein ..... 49/171 X
4,770,087 9/1988 Danley et al. ..... 98/87

*Primary Examiner*—Blair M. Johnson
*Attorney, Agent, or Firm*—Jordan and Hamburg

[57] ABSTRACT

The present invention relates to a shutter which is capable of ventilating air in a building. There is provided a slat, which has a through-hole covered with a net, in the upper section of the shutter; there is provided a slat, which is capable of adjusting the amount of ventilating air, in the lower section of the shutter. With this combination, fresh air is able to enter the building from the lower slat and air inside is able to flow out from the upper slat when the lower slat makes possible to ventilate.

5 Claims, 5 Drawing Sheets

SHUTTER AND A SLAT FOR THE SAME

BACKGROUND OF THE INVENTION

The present invention relates to a shutter, preferably to ventilate in buildings and structures, and a slat for the shutter.

A shutter whose upper section is opened so as to ventilate storehouses in which foodstuffs such as grains are stored.

In the shutter having the opening for mere ventilation, noxious insects, etc. sometimes enter the storehouse through the opening, they eat the grain or other foodstuffs stored therein. With mere opening in the upper section of the shutter, ventilating the storehouse cannot be executed. A shutter, whose opening is covered with a screen is also known. The screen is fixed by rivets, etc. but fixing work is troublesome and increases manufacturing steps, so that the manufacturing cost of the shutter is raised.

A shutter having windows for lighting has existed. This shutter is composed of base slat members in which through-holes are bored and a transparent plate is fixed at each through-hole to cover it. In this shutter, the transparent plates are manually and respectively fixed at each through-hole bored in slats. The manual work is also troublesome and manufacturing efficiency becomes low.

SUMMARY OF THE INVENTION

An object of the present invention is to provide a shutter, which is capable of fully ventilating a building, and a slat for the shutter.

To achieve the object, the present invention provides following structures.

A slat for a shutter according to the invention comprises, a having a through-hole for ventilation, a plurality of guides formed by cutting parts of the base member and forming the parts cut, each of the guides having an inserting section which opens in the longitudinal direction thereof, and a shutting plate having a window for opening and shutting the through-hole and being inserted from the inserting sections of the guides, the shutting plate being capable of sliding along a screen, which is inserted from the inserting sections of the guides which is fixed on the rear face of the basic material and which covers the through-hole, and/or is capable of sliding with guiding by the guides whereby the shutting plate opens and shuts the through-hole.

In the slat, the height or the width of the opening on the inserting side, from which the screen and/or the shutting plate is inserted, of each of the guides may be higher than the other side thereof.

Further, a shutter according to the invention has multiple slats which are mutually connected in the up-down direction, a slat in the upper section of the shutter comprising a base slat member having a through-hole for ventilation, a plurality of guides formed by cutting parts of base slat member and forming the parts cut, each of the guides having an inserting section which is open in the longitudinal, i.e., lengthwise, direction, and a screen inserted through the guides from the inserting sections so as to cover the through-hole and fixed on the rear face of the base member, and a slat in the lower section of the shutter comprising a base member having a through-hole for ventilation, a plurality of guides formed by cutting parts of the basic material and forming the parts cut, each of the guides having an inserting section which opens in the longitudinal direction of the base member a screen inserted from the inserting section of the guides and covering the through-hole, the screen being fixed on the rear face of the base member and a shutting plate having a window for opening and shutting the through-hole and being inserted from the inserting sections of the guides, the shutting plate being capable of sliding along the screen with guiding by the guides.

In this shutter, fresh air is able to enter a building from the through-hole of the slat in the lower section and air in the building flows out from the through-hole of the slat in the upper section when the window of the shutting plate of the slat in the lower section coincides with the through-hole of the slat thereof, so that ventilation is executed. Note that by bringing the window of the shutting plate into partial registry with to the through-hole of the slat, the amount of ventilating air can be adjustable.

If the slats in the upper and the lower sections have screens enough ventilation can be provided while noxious insects are prevented from entering the building.

Further, the screen and the shutting plate can be attached easily, because the seats include the guides.

BRIEF DESCRIPTION OF THE DRAWINGS

The present invention will be apparent from the following description, reference being had to the accompanying drawings wherein preferred embodiments of the present invention are clearly shown.

In the drawings.

DETAILED DESCRIPTION OF PREFERRED EMBODIMENTS

Preferred embodiments of the present invention will now be described in detail with reference to the accompanying drawings.

Figure 1:
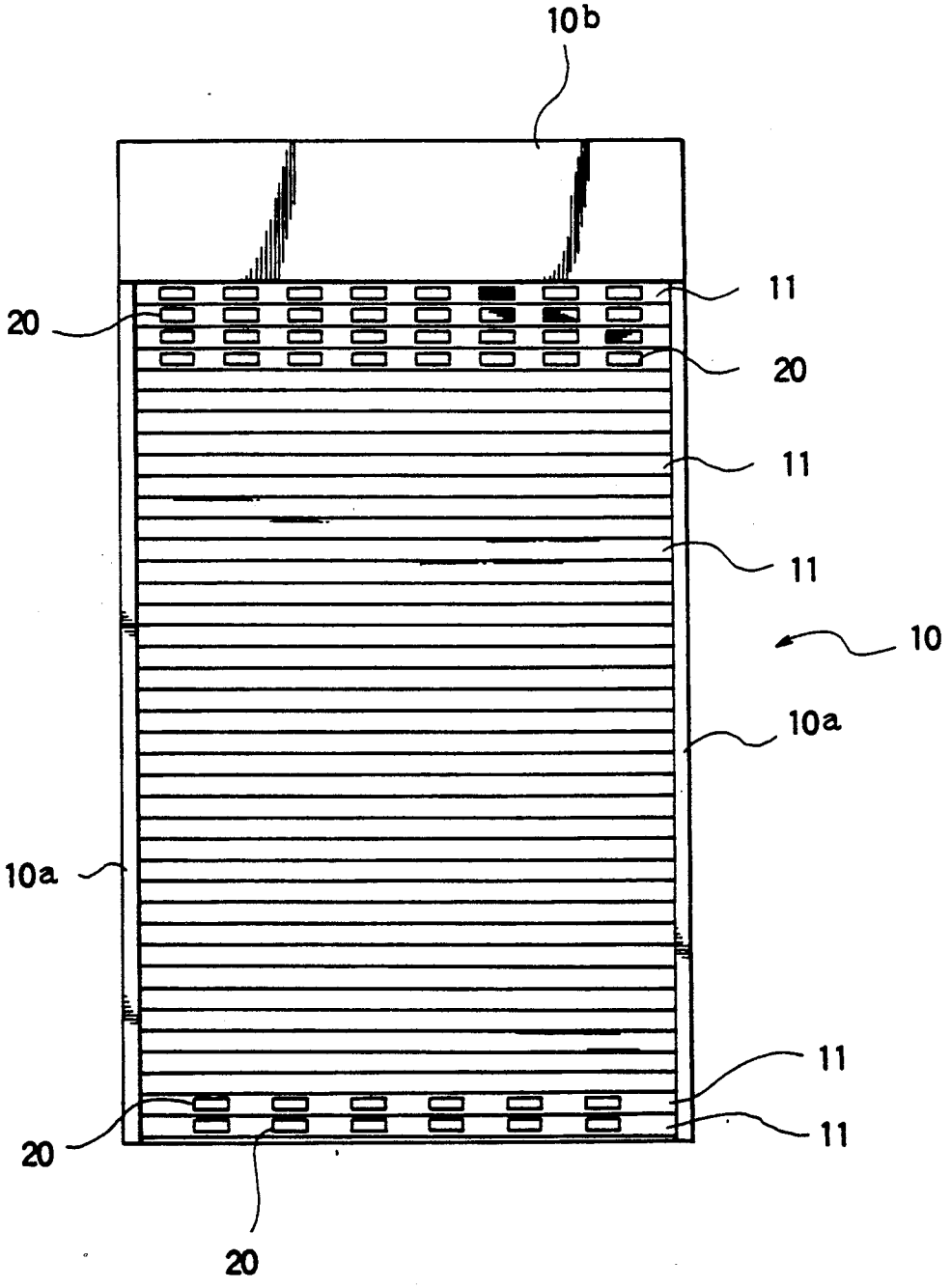
FIG. 1 is a front view an entire of the present invention.

A shutter 10 is composed of a plurality of slats, which are connected by connecting sections, as shown in FIG. 1.

The shutter 10 is supported by two rails 10*a*, which guide both edges of the slats 11. There is provided an accommodating box 10*b*, which rolls up the shutter 10 and accommodates it, above the shutter 10.

Each slat 11 has connecting sections 12*a* and 12*b* along the upper and the lower end section of the base member 12 of the slat 11. The slats in the upper and the lower parts of the shutter 10 respectively have a plurality of through-holes 20. In this embodiment, four slats 11 in the upper part and two slats 11 in the lower part respectively have the through-holes 20.

First, the slat 11 in the upper part will be explained.

Figure 2:
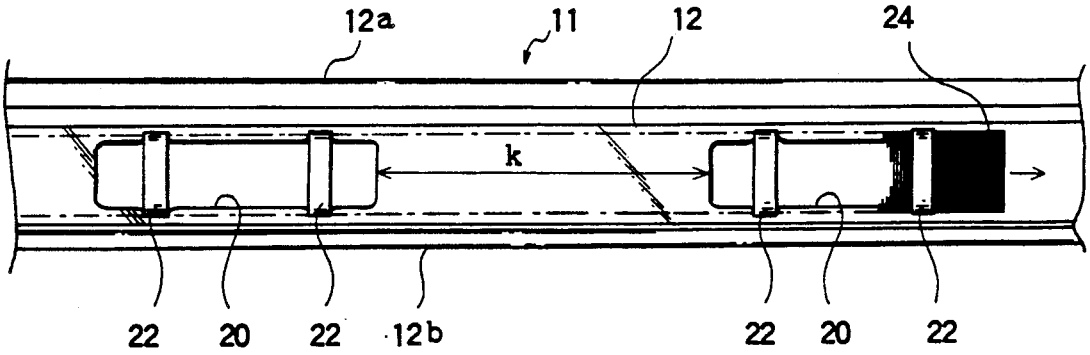
FIG. 2 is a rear view of a part of a slat.
Figure 3:
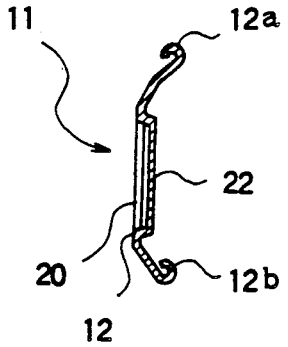
FIG. 3 is a longitudinal sectional view of the basic material of the slat.
Figure 4:
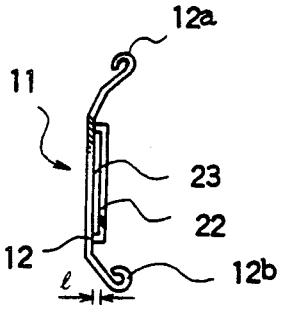
FIG. 4 is a side view of the basic slat.
Figure 5:
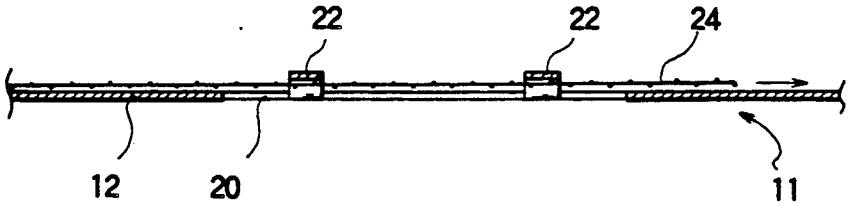
FIG. 5 is a partial transverse sectional view of the basic slat.

Guides 22 are provided in the slat 11 so as to cover parts of the through-hole 20 (see FIG. 2). The guides 22 are formed to project backward. Namely, both edges of the base member 12 are not cut away perhaps of the base member intended to form the guides 22 and those portions are formed backward at said section so as to form the guides 22. With this structure, a clearance "l" is kept between the rear face of the basic material 12 and the guide 22 and an insert-hole 23 is formed. A band-like screen 24 can be inserted through the insert-hole 23 of the guide 22 along the rear face of the basic material 12 from one end side of the basic material 12.

Figure 6:
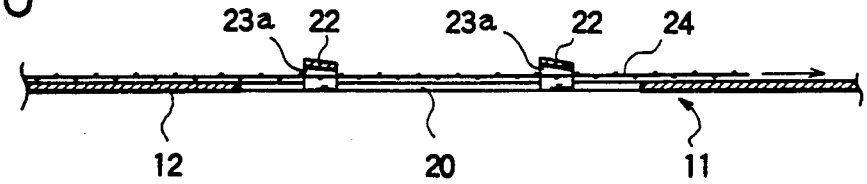
FIG. 6 is a partial transverse sectional view of another basic slat.

To easily insert the screen 24, the height of the inserthole 23*a* on the inserting side, from which the screen 24 is inserted, may be higher than the other side (see FIG. 6).

If clearance "K" between the through-holes 20 (see FIG. 2) is narrower than the width of the through-hole 20 and the through-holes 20 are closely arranged, the efficiency of ventilation can be raised.

If the width of the insert-hole 23 is reduced after the net 24 is inserted therethrough, the movement of the screen 24 can be prevented.

One example of forming the guide 22 will be explained.

Two cuts are formed in the transverse direction of the basic material 12. The part between the cuts is transformed to be the guide 22 with plastic deformation. After then, the through-hole 20 is formed. In this case, forming the guide 22 and the through-hole 20 can be executed in one action by press forming.

In the above noted embodiment, the guide 22 corresponds to the through-hole 20, so that the guide 22 certainly presses the screen 24 to the fringe of the through-hole 20. With this pressing, it is hard to make a gap between the screen 24 and the rear face of the basic material 12.

Figure 7:
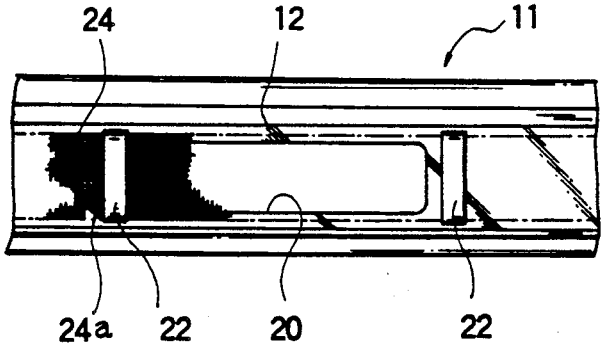
FIG. 7 is a partial rear view of the basic slat whose through-holes are covered with screen.

The guides 22 may be located at positions shifted from the through-hole 20 of the basic material 12 as shown in FIG. 7. The guide 22 is formed by cutting the basic material 12 is the longitudinal direction to make two cuts and transforming the part between the cuts with plastic deformation. Note that, sliding the screen 24 is the longitudinal direction can be prevented by cutting the screen 24 and piling the part 24*a* cut. The part 24*a* of the screen 24 piled cannot pass through the guide 22 and the location of the screen 24 is fixed.

Successively, the slats 11 in the lower section will be explained with reference to FIGS. 8 and 9.

As similar to the slats 11 in the upper section, there are formed the guides 22 and the through-holes 20 in the slats 11 in the lower section. The screen 24 and shutting plate 27, which are stacked together, are inserted through the insert-holes 23 of the guides 22 of the slats 11 in the lower section. Namely, similar to the slats 11 in the upper section, the screen 24 is inserted through the insert-holes 23 along the rear face of the basic material 12, and then the shutting plate 27 is inserted between the screen 24 and the basic material 12. With this structure, the shutting plate is clipped by the basic material 12 and the screen 24 and is capable of sliding.

There are opened windows 27*a*, whose positions correspond to the through-holes 20 of the slat 11, in the shutting plate 27. It is preferable to provide two reinforcing plates 27*b* at the mid section of each window 27*a* so as to reinforce the shutting plate 27 (see FIG. 9).

Figure 8:
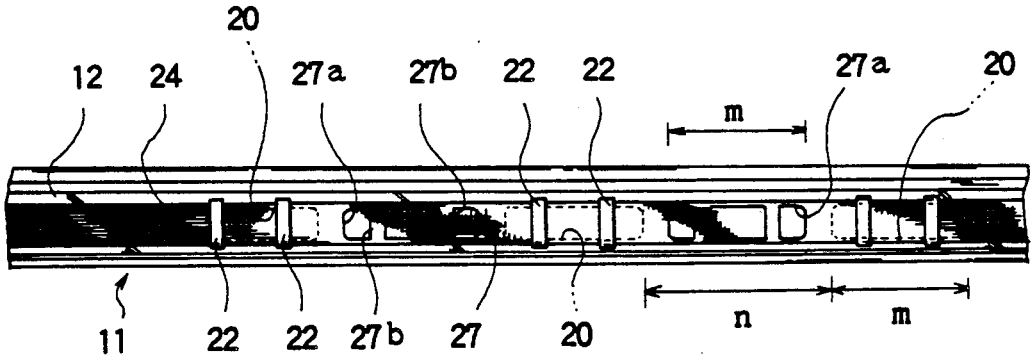
FIG. 8 is a rear view of the slat having the screen and a shutting plate wherein windows of the shutting plate do not coincide with the through-holes of the slat.
Figure 9:
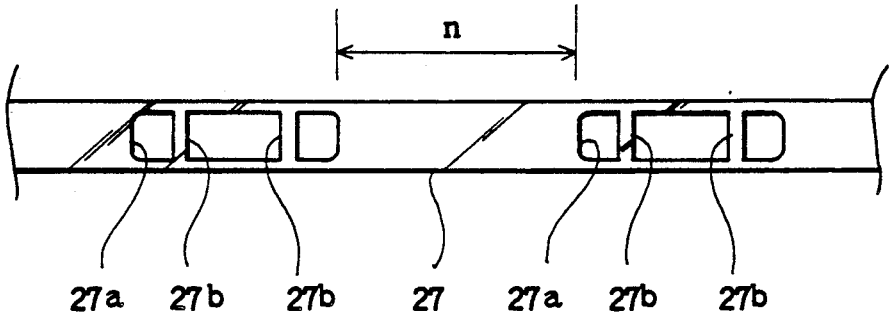
FIG. 9 is a front view of the shutting plate.
Figure 10:
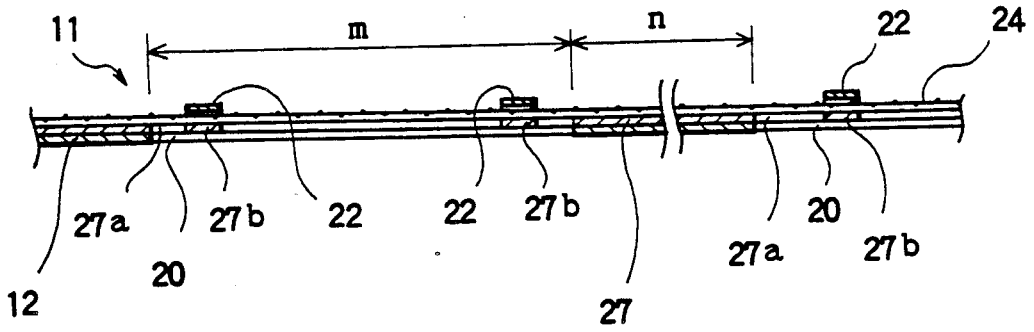
FIG. 10 is a transverse sectional view of the slat of FIG. 8.

The status in which the through-holes 20 of the basic material 12 coincide with the windows 27*a* of the shutting plate 27 and in which ventilation can be executed is shown in FIG. 10; the status is which the windows 27*a* are shifted from the through-holes 20 to close the through-holes 20 is shown in FIG. 8.

It is necessary that the length (n) of the through-holes 20 or the windows 27*a* is longer than the distance (m) between the through-holes 20 or between the windows 27*a*, viz., $n > m$. Note that, shutting plate 27 is slidably inserted between the screen 24 and the basic material 12 but the screen 24 may be inserted between the shutting plate 27 and the basic material 12.

Figure 11:
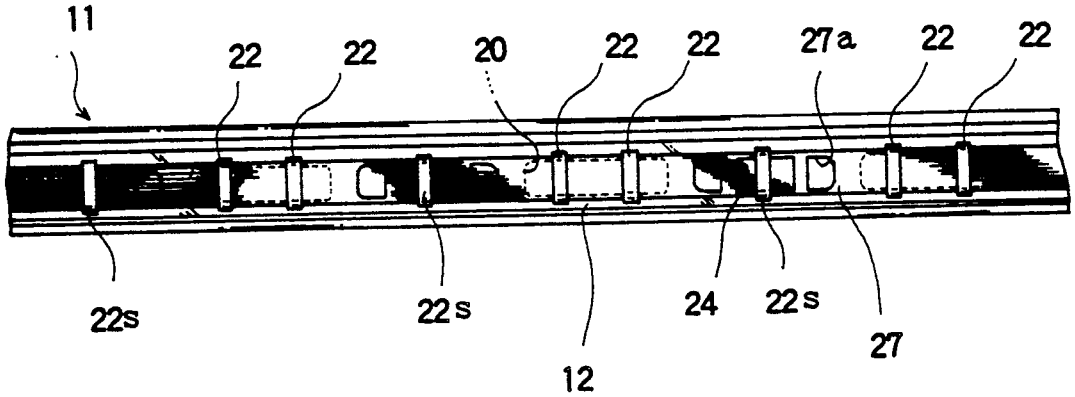
FIG. 11 is a rear view of the slat wherein guides are provided between the through-holes, and the screen and the shutting plate are assembled.

Guides 22*s*, whose structure is the same as the above noted guides 22, may be provided between the through-holes 20 in case that the distance between the through-holes 20 is long (see FIG. 11). In case of FIG. 11, the screen 24 and the shutting plate 27 never slacken at the midway section thereof. Further, similar to the example shown in FIG. 7, the piled part 24*a* (see FIG. 7) of the screen 24 may be formed in the vicinity of the guides 22*s* so as to prevent the screen 24 from sliding.

The shutter is preferably made of thin metal such as stainless steel. The metal shutting plate 27 shields the light but the shutting plate 27 made of transparent material can introduce the light inside.

Successively, the function of the shutter will be explained.

The through-holes 20 for ventilation through the slats 11 in the upper section of the shutter 10 are covered with the screen 24. The slats 11 in the lower section of the shutter 10 can be changed between ventilation mode and non-ventilation mode by shifting the shutting plate 27.

When the slain 11 in the lower section are changed to the ventilation mode, the windows 27*a* coincide with the through-holes 20, so that fresh air is introduced through the through-holes 20 of the lower slats 11; the air inside is exhausted through the through-holes 20 of the upper slats 11. The air in a building can be ventilated smoothly.

When a part of the windows 27*a* coincide with the through-holes 20, the opening area of the through-hole 20 can be adjustable, so that the amount of ventilation can be adjustable.

When the shutting plate 27 is further slided to close the through-holes 20 as the non-ventilation mode, introducing fresh air through the through-holes 20 of the lower slats 11 is stopped, so that the ventilation of the building stops then.

Note that, the slats 11 of the lower section may have only the shutting plate 27 for ventilation without the screen 24.

Successively, other examples of the guide will be explained.

FIGS. 12–15 show front views and sectional side views of the slat.

Figure 12:
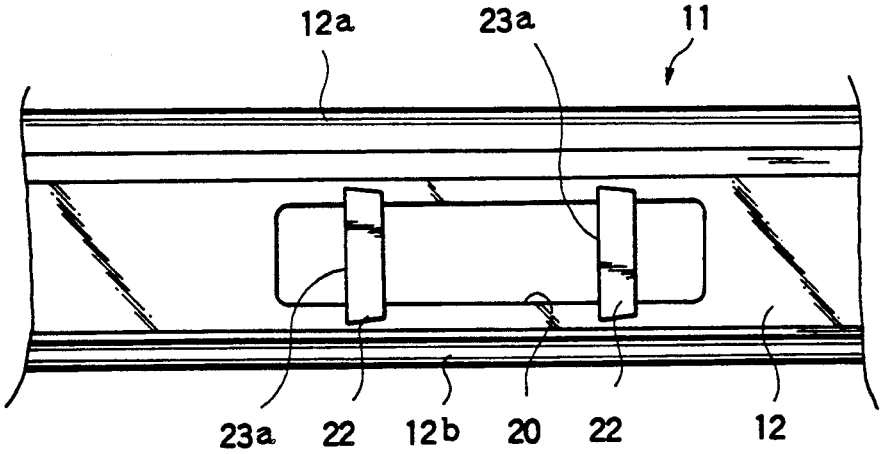
FIG. 12 is a partial rear view of the slat wherein the width of the inserting side of the guides is made wider than the other side.

In FIG. 12, the width of the opening on the inserting side 23*a* of the guides 22 is wider than the other side thereof. The screen 24 or the shutting plate 27 can be inserted easily.

Figure 13:
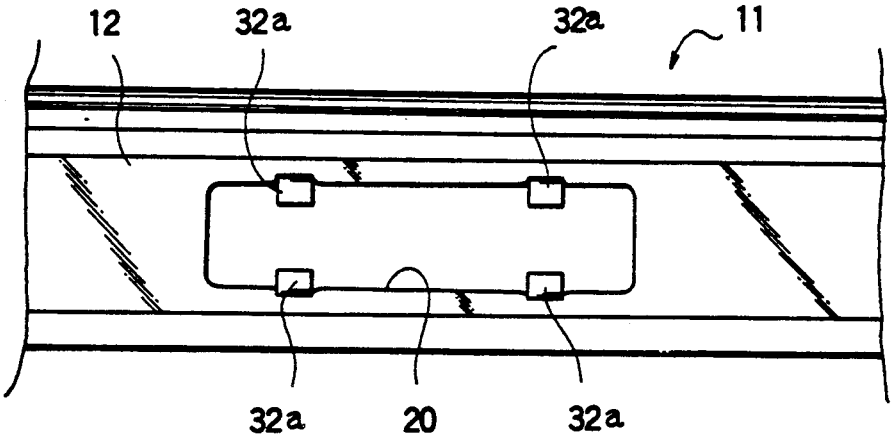
FIG. 13 is a front view of the slat wherein the guides are of another configuration.
Figure 14:
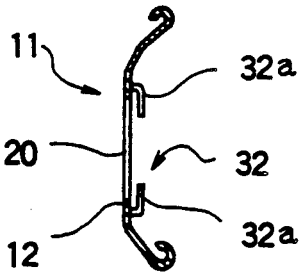
FIG. 14 is a sectional view of the slat of FIG. 13.

In FIGS. 13 and 14, the mid section of the guides 22 described above is cut. Namely, L-shaped guide pieces 32*a* are mutually projected upward and downward to compose the guides 32. The guide pieces 32*a* are formed, as same as the above noted guides 22, by cutting and transforming a part of the basic material 12.

Figure 15:
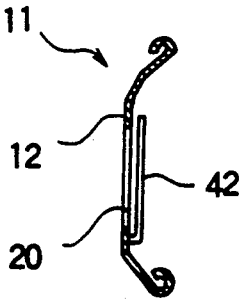
FIG. 15 is a sectional view of a basic slat having other guides.
Figure 16:
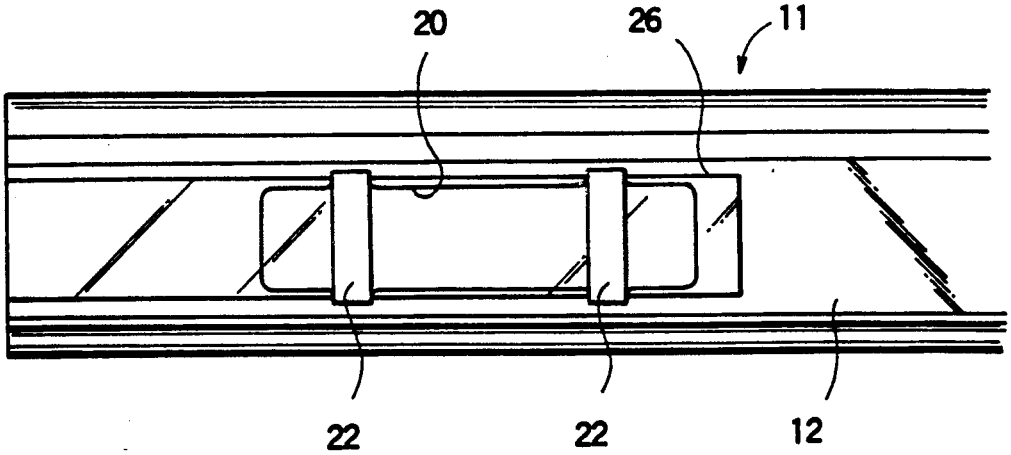
FIG. 16 is a rear view of the slat wherein the shutting plate is inserted through the insert-holes of the guides.

In FIG. 15, the guides 42 are formed into a long L shape. The lower end of the guide 42 is fixed at the basic material 12; the upper end is opened. In this case, too, the screen 24 and the shutting plate 27 can be inserted through the guides 42. The screen 24 and the shutting plate 27 can be assembled from the open end of the guides 42. Therefore, this guide 42 has function and effectiveness similar to the above noted guides. The guide 42 is, similar to the above noted guide 22, formed by cutting and transforming a part of the basic material 12.

In the above described example, the guides 22, 22*s*, 32 and 42 are formed by cutting and transforming a part of the basic material 12, but the guides may be formed by fixing guide pieces, which are separately prepared, on the rear face of the basic material 12. In the case of using the guide pieces, the similar function and effectiveness can be got.

A transparent plate 26 can be inserted through the guides 22 as the shutting plate. In this case the light can be introduced inside.

Preferred embodiments of the present invention have been described in detail. The present invention, however, is not limited to the above described embodiments. Many modifications, of course, can be allowed without deviating from the spirit of the invention.

What is claimed is:

1. In a shutter comprising a plurality of slats, a slat comprising:

a base elongated slat member having a through-hole for ventilation, the through-hole having a pair of opposed edges extending in the direction of elongation of the base member;

a plurality of guides produced by cutting parts of said base member and forming the parts cut, each of said guides being in the form of a continuous integral strip elongated at right angles to the direction of elongation of the base member, being integral with said pair of opposed edges of said through-hole and having an inserting section which opens in the direction of elongation of the base member; and an elongated shutting plate having a window for opening and shutting the through-hole and being inserted from the inserting sections of said guides, a single elongated screen which is inserted from the inserting sections of said guides and is firmly fixed on the rear face of said base member by said guides and covers the through-hole, the shutting plate overlying and, while being guided by said guides, being capable of sliding along the screen, the guides bridging continuously across the shutting plate and the screen at right angles to the direction of elongation of the shutting plate and the screen.

2. In a shutter, a slat according to claim 1, wherein the height of the opening on the inserting side of each of said guides, from which said screen and said shutting plate are inserted, is higher than the other side thereof.

3. In a shutter, a slat according to claim 1, wherein the width of the opening on the inserting side of each said guide, from which said screen and said shutting plate are inserted, is wider than the other side thereof.

4. In a shutter, a slat according to claim 1, further comprising a stopper for preventing said screen and said shutting plate from sliding out from said guide.

5. A shutter having multiple slats, which are mutually connected in the up-down direction, the shutter comprising:

a slat in the upper section of said shutter comprising a base elongated slat member having a through-hole for ventilation, the through-hole having a pair of opposed edges extending in the direction of elongation of the base member, a plurality of guides produced by cutting parts of said base member and forming the parts cut, each of said guides being in the form of a continuous integral strip elongated at right angles to the direction of elongation of the base member, being integral with said pair of opposed edges of said through-hole and having an inserting section which opens in the direction of elongation of the base member, and a first elongated screen inserted through said guides from the inserting sections so as to cover the through-hole and firmly fixed on the rear face of said base member by said guides; and a slat in the lower section of said shutter comprising a base elongated slat member having a through-hole for ventilation, a plurality of guides produced by cutting parts of said base member and forming the parts cut, each of said guides being in the form of a continuous integral strip elongated at right angles to the direction of elongation of the base member, being integral with said pair of opposed edges of said through-hole and having an inserting section which opens in the direction of elongation of the base member, a second elongated screen inserted from the inserting section of said guides and covering the through-hole, said second screen being fixed on the rear face of said base member by said guides, and a shutting plate having a window for opening and shutting the through-hole and being inserted from the inserting sections of said guides, the shutting plate overlying and, while being guided by said guides, being capable of sliding along said second screen, the guides bridging continuously across the shutting plate and the second screen at right angles to the direction of elongation of the shutter plate and the second screen.

* * * * *